United States Patent [19]

Bill et al.

[11] 4,035,211

[45] July 12, 1977

[54] FORMING SEALED SEAMS IN MOISTURE BARRIERS FOR CABLE

[75] Inventors: Robert George Bill, Baltimore; Edward Louis Franke, Jr., Perry Hall, both of Md.

[73] Assignee: Western Electric Company, Inc., New York, N.Y.

[21] Appl. No.: 659,078

[22] Filed: Feb. 18, 1976

Related U.S. Application Data

[63] Continuation-in-part of Ser. No. 485,181, July 2, 1974, abandoned.

[51] Int. Cl.[2] ..... H01B 13/10

[52] U.S. Cl. ..... 156/54; 156/56; 156/203; 156/461; 156/466

[58] Field of Search ..... 156/203, 466, 54, 52, 156/461, 215, 218; 174/102 R, 102 C, 102 D, 106 D, 103, 107; 228/129, 130, 150

[56] References Cited

U.S. PATENT DOCUMENTS

| | | | |
|---|---|---|---|
| 2,403,995 | 7/1946 | Peters | 156/218 |
| 3,172,388 | 3/1965 | Riso | 228/130 X |
| 3,574,016 | 4/1971 | Wahlberg | 156/54 |
| 3,597,292 | 8/1971 | Takeda | 156/466 X |
| 3,819,473 | 6/1974 | Russell | 156/218 X |

FOREIGN PATENT DOCUMENTS

| | | | |
|---|---|---|---|
| 96,555 | 6/1960 | Norway | 156/54 |

*Primary Examiner*—David A. Simmons
*Attorney, Agent, or Firm*—E. W. Somers

[57] ABSTRACT

In the manufacture of a communications cable, a moisture barrier comprising a corrugated metallic tape having inwardly and outwardly facing major surfaces is wrapped longitudinally about an advancing cable core to form an overlapping seam, with at least a portion of each of the major surfaces which form the seam being precoated with an adhesive copolymer material. Heat is applied to at least the portions of the moisture barrier which form the seam while the portions are spaced apart a distance sufficient to permit a stripe of adhesive copolymer material in molten form to be introduced into engagement with a longitudinal edge portion of the precoated outwardly facing surface which is destined to form the seam and which is disposed generally horizontally. Then the cable core and moisture barrier are advanced between coacting rollers which apply forces to the moisture barrier to cause the spaced apart portions to engage each other with the stripe engaging the precoated longitudinal edge portion of the inwardly facing surface which forms the seam and filling the spaces between associated corrugations to form an essentially continuously sealed seam. A longitudinally extending mandrel supports the barrier during the application of the forces to preserve the configuration of the enclosed core and to prevent damage to the core or the moisture barrier.

8 Claims, 8 Drawing Figures

FIG. 5

FORMING SEALED SEAMS IN MOISTURE BARRIERS FOR CABLE

CROSS-REFERENCE TO RELATED APPLICATION

This is a continuation-in-part of application, Ser. No. 485,181 filed July 2, 1974 now abandoned.

BACKGROUND OF THE INVENTION

1. Field of the Invention

This invention relates to forming sealed seams in moisture barriers for cables and, more particularly, to methods of and apparatus for causing overlapping portions of a longitudinally formed moisture barrier wrapped about an advancing cable core to be bonded continuously adhesively to foreclose the ingress of moisture into the cable core.

2. Description of the Prior Art

It is well known that the diffusion of water vapor in a uni-directional manner through a cable jacket into the core will have a detrimental effect on the transmission characteristics of the cable. It is also well known that a metallic tube surrounding the cable core provides an effective barrier against moisture diffusion into the cable core. Since most communications cables require an electrically conductive, metallic sheath, to shield against external electrical signals, it is usually desirable to incorporate the shielding function with the moisture barrier function in one single layer of metal.

The tube which comprises the moisture barrier is generally made from a single strip or tape of metal wrapped longtiudinally about the cable core to form an overlap seam. Moreover, in order to impart greater flexibility to the cable, the moisture barrier is frequently corrugated prior to being wrapped about the core.

The effectiveness of the tube as a moisture barrier is enhanced greatly if the resulting overlapping seam is sealed. A most effective seam seal is one in which a metal-to-metal bond exists, such as a welded or soldered seam. See, for example, U.S. Pat. Nos. 3,172,388 and 3,203,085, incorporated by reference hereinto. Norwegian Pat. No. 96,555 shows a device which extends between a portion of a shield and a core to support the shield during the application of closing forces thereto.

Problems arise when attempting to weld or solder a seam because of the high temperatures involved in most welding processes. The materials which make up most communications cables are temperature-sensitive and easily damaged if over-heated.

Problems arise in attempting to seal the seam because the material from which it is generally preferred to construct the barrier is aluminum. Because of its highly reactive nature, the aluminum maintains almost consistently an oxide film which virtually precludes continuous soldering as a joining technique for the overlapped seam.

Further, the strip or tape from which the moisture barrier is formed is extremely thin, e.g., on the order of 4 to 6 mils. The thinness of the barrier coupled with the typical corrugated configuration render undesirable the use of welding or soldering for sealing the seam.

It has been found that a sealed moisture barrier can be obtained by adhesively joining the overlapped seam. This may be accomplished by using adhesive-copolymer aluminum laminates at least for those portions of the barrier which form the seam. The application of adhesive copolymers in laminates is discussed by B. Wargotz in an article "Environmental Stability of Ethylene-Acrylic Acid Adhesive Copolymers Bonded to Metal Substrates" pulished in Vol. 12 of the *Journal of Applied Polymer Science*, pages 1873–1888 (1968) and incorporated by reference hereinto. See also U.S. Pat. No. 3,681,515, and "Notes on the Manufacture of Bonded Jacket Cables and Plastic Pipes Lined wtih Zetabon" published by the Dow Chemical Company of Midland, Michigan in 1970.

The art abounds with patents relating to moisture barriers or tube-making with bonded-type longitudinally formed, overlapped seams. In U.S. Pats. No. 3,574,016 issued to R. R. Wahlberg, an overlapped seam is sealed with an acrylic acid ethylene copolymer tape which has been inserted into the seam and subsequently heated by the extrusion of a thermoplastic jacket over the metallic strip. In an alternate embodiment in that patent, there is shown a cable sheath in which the inside surface of the metallic strip is precoated with an adhesive copolymer. A still further embodiment discloses the combining of a precoating of the shield with a film of adhesive copolymer on the inwardly facing major surface with the introduction of a strip of adhesive material into the seam portion.

Another patent, U.S. Pat. No. 3,703,605, issued to M. R. Dembiak and G. W. Webster, shows a moisture barrier coated across the entire transverse width on the outwardly facing surface and along an edge portion or the portion of the strip which forms the overlapped seam. The compositions of the coatings are different to permit a thin striping of the inwardly facing surface in order to avoid specific manufacturing problems.

F. F. Polizzano U.S. Pat. Nos. 3,504,102 and 3,575,748 and O. G. Garner, Pat. No. 3,332,133 show coated moisture barriers with overlap seams. U.S. Pat. No. 3,409,734 issued to H. Devine et al. discloses a narrow band of adhesive applied to the inside surface of an outer layer of a tape enclosing a metal strand and bonded to the underlying tape surface so as to leave a fine strip of the tape adjacent to the edge free from adhesive. See also U.S. Pat. No. 3,260,636 issued to H. Witzenmann, U.S. Pat. No. 3,471,350 issued to R. V. O'Berry et. al. and I. H. Marantz U.S. Pat. No. 3,558,378. Shigekazu Takeda U.S. Pat. No. 3,597,292 discloses a nozzle distributing a molten resin in the longitudinal overlapped seam portion of synthetic resin fabrics.

The related art of pipe-making includes, for example, F. W. Yeager, U.S. Pat. No. 2,044,456, U.S. Pat. No. 775,541 issued to J. A. McConnell and U.S. Pat. No. 2,897,875.

In the can making art, U.S. Pat. No. 3,066,063 shows a web brought into a tubular configuration with a seam sealing ribbon such as a fiber coated with a suitable adhesive, thin gage metal, or a synthetic resin of flexible coherent material extruded or fed as a preformed ribbon into engagement with portions of the overlapped seam portions and rollers. The rollers form the semi-molten ribbon into an S-shape about the longitudinal seam edges. Subsequently, rollers force the seam portions into intimate superposed relation while the web is being cooled.

Despite the numerous processes for forming a longitudinal seam having integrity against moisture diffusion, problems are yet experienced in obtaining consistently a reliably sealed seam in cable manufacture, especially when the metallic tape is corrugated. With the trend toward an increased number of corrugations per unit length, the misregistration of corrugations at the overlapped seam causes excessively deep valleys. This results in non-engagement of the adhesive on some of the opposing faces, thereby providing undesirably gaps in the seam.

The use of a preformed or semi-molten tape advanced into engagement with portions of an overlap seam has been found not to be effective in producing cables having a corrugated moisture barrier. Forces required to insure that the tape in either form is deformed sufficiently to fill any misregistration voids have the undesirable effect of tending to flatten the corrugations. Moreover, any forming of such a tape in a configuration, for example, to seal the longitudinal edges, may cause problems because of the alternating peaks and valleys of a corrugated barrier.

SUMMARY OF THE INVENTION

This invention relates to forming a tubular moisture barrier having a sealed overlapped seam for communications cables, in which an elongated strip is advanced along a path and is formed with longitudinal edge portions being adjacent each other. The strip has an inwardly facing surface and an outwardly facing surface with an adhesive material precoated at least along a longitudinal edge portion of the major surfaces which are destined to form an overlapped seam. The adjacent longitudinal edge portions which are destined to form the seam are spaced apart a distance sufficient to permit a molten adhesive copolymer material to be flowed into engagement with at least one of the precoated adjacent longitudinal edge portions of the major facing surfaces of the strip which is to form the overlapped seam. Relative movement is caused to occur between the longitudinal edge portions to reform the overlapped seam to cause the flowed molten adhesive copolymer material to engage the other precoated longitudinal edge portion to bond the overlappd portions to seal the seam.

More particularly, a cable core is advanced along a predetermined path, while a metallic corrugated tape having an adhesive copolymer material precoated along at least longitudinal edge portions of inwardly and outwardly facing major surfaces thereof is formed about the advancing cable core in order to provide an overlapped seam with adhesive copolymer on the outwardly facing surface and the inwardly facing surface being opposed in order to provide an adhesive bond. As the cable core with the corrugated tape is advanced along the manufacturing line, the portions of the tape forming the seam are separated slightly such that an inner longitudinal edge portion is essentially horizontal with heat applied thereto and a stripe of molten adhesive copolymer material is extruded into engagement with the inner longitudinal edge portion. Subsequently, the core and enclosing tape are advanced between a pair of opposing coacting rollers which are exposed to a chilled ambient atmosphere with a mandrel being interposed between the cable core and the seam portion in order to provide support for forces applied by the pressure rollers. The rollers cause the extruded stripe of molten adhesive copolymer to engage the adhesive copolymer precoated on the opposing outer longitudinal face at the overlapped seam in order to bond together the longitudinal edge portions to provide a consistently reliably sealed seam. Subsequently, the cable core with the corrugated tape having the sealed seam is preheated and finally jacketed, after which the finished cable is taken up on a reel.

BRIEF DESCRIPTION OF THE DRAWINGS

Other objects and features of the present invention will be more readily understood from the following detailed description of specified embodiments thereof when read in conjunction with the accompanying drawings in which.

DETAILED DESCRIPTION OF THE INVENTION

Figure 2:
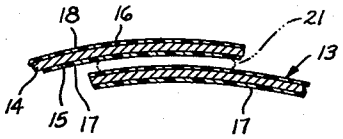
FIG. 2 is an enlarged detail view of the overlappd seam of a moisture barrier construction with a stripe of adhesive extrusion-introduced between opposing faces of the seam.
Figure 1:
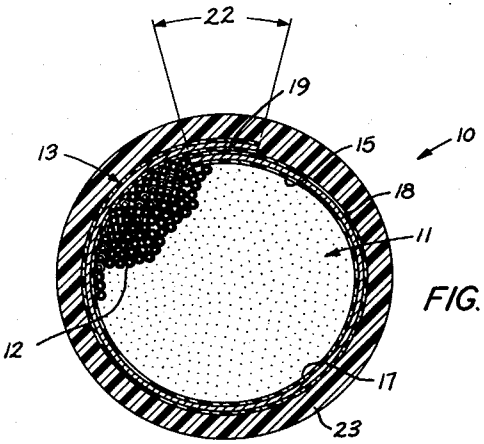
FIG. 1 is a cross-sectional view of a cable core showing a moisture barrier wrapped about the core with an overlapped seam and in relation to a jacket and the core.

As is shown in FIGS. 1 and 2, a cable, designated generally by the numeral 10, includes a core, designated generally by the numeral 11, which includes a plurality of conductors 12—12. The cable core 11 is enclosed by a moisture barrier, designated generally by the numeral 13, which includes a metallic tape 14. The metallic tape 14, generally constructed of aluminum, has an inwardly facing surface 15, which faces the core 11, and an outwardly facing surface 16. The inwardly and the outwardly facing surfaces 15 and 16, respectively, in this embodiment are covered with an adhesive copolymer material layer 17 and 18, respectively, across the entire transverse widths thereof. The adhesive layers 17 and 18 are bonded together along the interface 19 thereof by an adhesive stripe 21 in accordance with the principles of this invention to form a continuous bonded seam 22. Subsequently, the moisture barrier 13 has a jacket 23 extruded thereover.

The moisture barrier 13 may be manufactured during the cable-making operation or is available commercially as a separate item. For example, a 4 mil thick aluminum tape coated on each side thereof with a two mil thick adhesive copolymer layer is available from the Dow Chemical Company under the designation "Zetabon®." See U.S. Pat. No. 3,681,515 and "Notes on the Manufacture of Bonded Jacket Cables and Plastic Pipes lined with Zetabon®" as published in 1970 by the Dow Chemical Company and both of which are incorporated by reference hereinto.

In a preferred embodiment, the tape 14 is precoated with adhesive copolymer material across the entire transverse widths of the inwardly and outwardly facing major surfaces 15 and 16 thereof. However, it is within the scope of this invention to use a tape 14 in which only those longitudinal edge portions of the major surfaces which are to form the seam are precoated.

Figure 3:
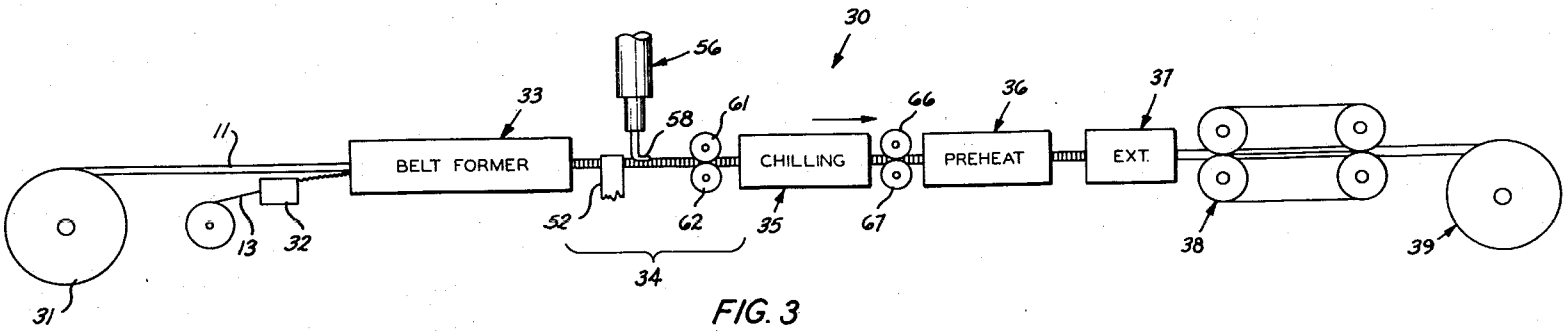
FIG. 3 is a simplified view in elevation showing facilities for manufacturing a communications cable as the cable core, comprised of a plurality of conductors, is advanced along a manufacturing line through a plurality of stations.

A manufacturing apparatus 30, which may be employed to manufacture the cable 10, is shown in FIG. 3 and includes a supply reel 31 of a continuous length of the core 11. The core 11 is advanced along a predetermined path with a separate supply of the coated tape 14 being advanced through a corrugator, designated generally by the numeral 32. After being corrugated, the tape 14 is fed into a belt former, designated generally by the numeral 33, which wraps the tape longitudinally around the cable core 11. The enclosed cable core 11 is advanced through facilities, designated generally by the numeral 34, in which the stripe 21 of molten adhesive copolymer material is extruded between separated, opposing faces of the corrugated tape 14. After the extrusion of the faces of the corrugated tape 14. After the extrusion of the stripe of molten adhesive copolymer material, the overlapped seam 22 is reclosed in a chilled ambient atmosphere, and the enclosed core 11 is advanced through chilling facilities 35. The enclosed core 11 is advanced through a preheater 36 which preheats the moisture barrier 13 to facilitate the adhesion of a subsequently applied jacketing material to the coated metallic tape 14. Then the core 11 having a sealed seam moisture barrier 13 thereabout is advanced through an extruder 37, wherein the jacket 23 is extruded thereover. Then the communications cable 10 which is being advanced by a capstan 38 is taken up on a reel 39.

Figure 4:
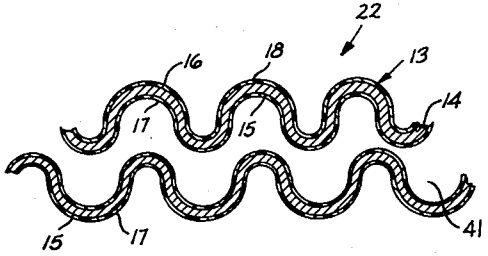
FIG. 4 is an enlarged detailed view showing a portion of the overlapped seam of a moisture barrier, which includeds a corrugated tape, just prior to the closing of the overlapping portions.

Referring now to FIG. 4, there is shown a cross-sectional view of portions of the overlapped longitudinally-formed seam 22 of the corrugated tape 14. It should be quite apparent that unless the corrugations are precisely formed and mated, portions thereof may not be in complete registration with associated portions at the overlap. Moreover, in recent years there has been a trend toward increasing the number of corrugations per inch of tape length. This makes it even more difficult to nest associated corrugations at the overlapped portion of the tape 14.

Because of potential misregistration of associated corrugations, it becomes somewhat difficult to obtain the bonding of the adhesive copolymer layers 17 and 18 which face each other on opposing portions of the tape seam 22. For example, in the portion of the seam designated by the numeral 41 (see FIG. 4), it can be seen that even though the opposing faces of the seam are coated with adhesive copolymer, there may be a space unoccupied by either at the overlap simply because of the misregistration of the corrugations. Hence, a portion of the seam 22 may not be bonded and the integrity of the moisture barrier 13 against moisture diffusion is put in jeopardy.

Figures 5, 6, 7, 8:
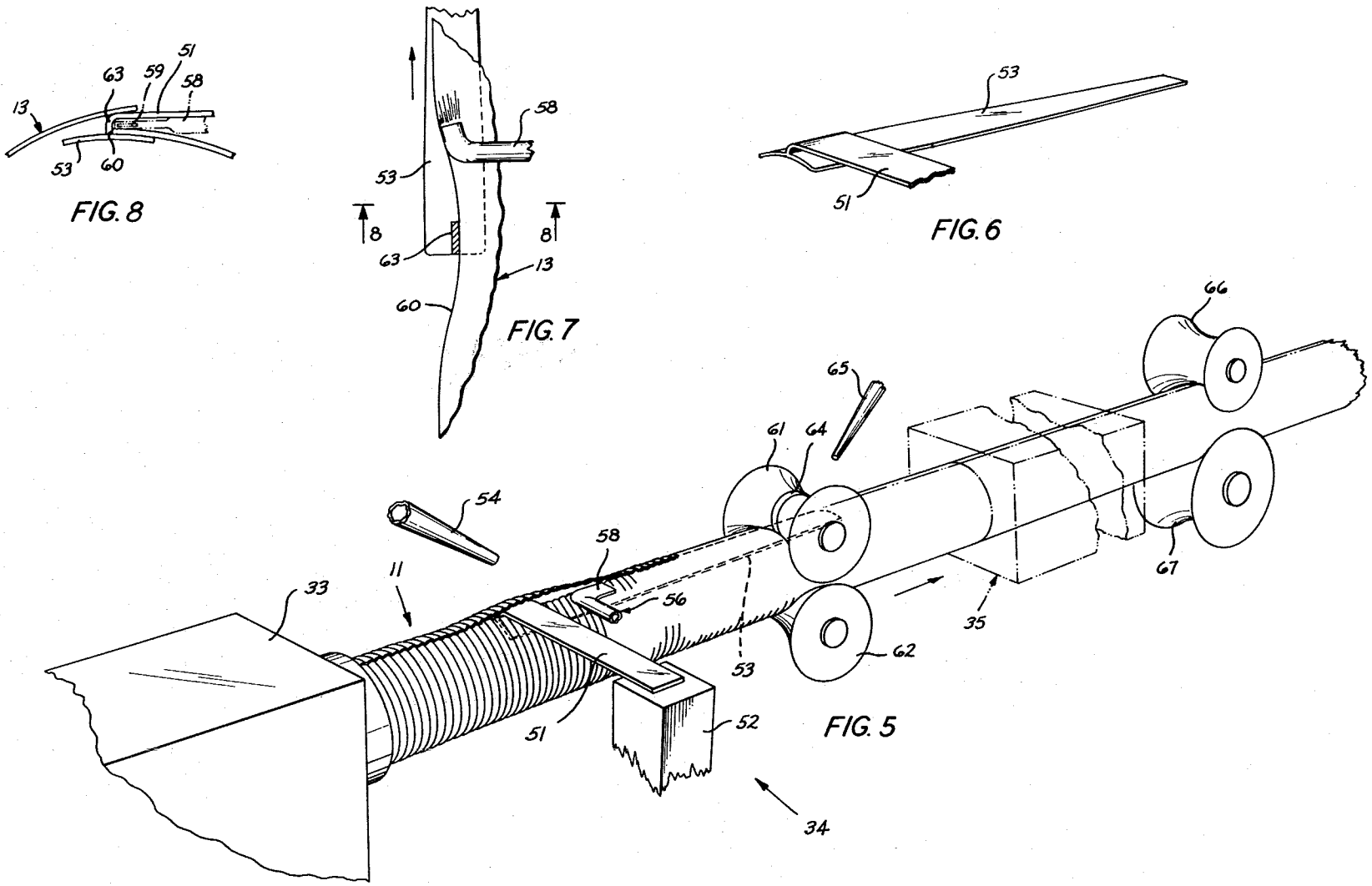
FIG. 5 is an enlarged perspective view of a portion of the manufacturing lines which shows the portions of the line which are used to carry out the principles and the method of this invention to introduce a stripe of adhesive into the overlapped seam.
FIG. 6 is an enlarged detailed view of a mandrel which is used to support the overlapped seam during the application of forces by two forming rollers.
FIG. 7 is a detailed plan view of portions of facilities which are used to separate the overlappd seam to facilitate the introduction of the stripe of adhesive.
FIG. 8 is a sectional view of a portion of the facilities used to open the seam prior to the introduction of the adhesive stripe and showing the portions of the tape which form the seam in relation to those facilities.

In order to overcome these problems, the methods of this invention may be used to obtain a continuously sealed seam 22. Referring now to FIG. 5, there is shown the apparatus 34 for carrying out the principles of this invention. The cable core 11 is shown being advanced out of the belt former 33 and then past a device 51 (see also FIG. 6) which extends transversely of the cable core from a support post 52. The device 51 is positioned so as to be interposed between the overlapped seam portions.

The device 51 has a dual function. When the cable core 11 is advanced past the device 51, the device separates slightly the overlapping portions of the moisture barrier 13 and causes them to be spaced apart for a short distance, e.g., 8 inches, along the path of travel. Moreover, the device 51 has a longitudinally extending mandrel 53 which extends in a downstream direction from the device 51. The mandrel 53 permits closing forces to be applied to the seam 22 without destroying the circular configuration of the core 11 or inflicting damage to the core. The separation of the opposing portions of the moisture barrier 13 which form the seam 22 permits the introduction therebetween of additional adhesive material.

Also shown in FIG. 5 is a device 54 for applying heat to at least those portions of the moisture barrier 13 which form the overlapped seam 22 in the vicinity of the seam separating device 51. The device 54 directs streams of heated air having a temperature of approximately 1000° F into engagement with the seam area, and portions contiguous thereto, of the moisture barrier 13. This causes the temperature of the aluminum tape to be elevated to approximately 200° F.

In this way, the entire seam area is in a heated condition, thereby enhancing the filling of the spaces, such as 41 shown in FIG. 4, with supplemental adhesive copolymer and thereby increase the probability for obtaining a reliably sealed seam between all the corrugations.

The separation of the opposing faces of the moisture barrier 13 permits an extruder, designated generally by the numeral 56, to extrude the thin stripe or ribbon 21 (see FIG. 2) of adhesive copolymer material into the seam between overlapping opposing faces of the moisture barrier. The extruder 56 includes a die 58, which in a preferred embodiment has approximately a 10 mil thick slot 59 (see FIG. 8).

The extrusion of the stripe 21 of molten adhesive copolymer material is performed to insure a sealing of the seam 22. Referring now to FIG. 8, it can be seen that as the core 11 is advanced past the device 51, the external overlapping portion of the moisture barrier 13 rides up over the device 51, while the internal portion of the moisture barrier has an edge 60 moving in engagement with a downturned end 63 of the device 51. This causes the edge 60 to be moved out of line with its path of travel upstream and downstream of the apparatus 34 (see FIG. 7).

In this way, the die 58 may be positioned to flow the strip 21 of molten adhesive copolymer material on the barrier 13 prior to the edge 60 resuming its normal path of travel. This avoids requiring the die 58 to be positioned vertically below the upper portion of the moisture barrier 13. Also, the die 58 is positioned so as to be spaced slightly above the peaks of the corrugations of the inner portion of the moisture barrier 13 along the seam. The positioning of the die 56 apparently causes the material to be moved out of the die onto the portion of the outwardly facing surface of the inner portion of the moisture barrier 13 which forms the seam.

The adhesive copolymer which is applied by the extruder 56 into the seam 22 is accomplished to provide the stripe 21 as is shown in FIG. 2 with the stripe being slightly less in width than the seam width itself. For example, a minimum acceptable seam width is approximately 0.25 inch with the seam 22 generally being 0.375 to 0.5 inch in width. The width of the extruded stripe 21 is generally 0.25 inch and has a thickness of about 0.010 inch, these dimensions being imprecise because of the molten form.

Moreover, it is important that the adhesive copolymer material is flowed in molten form into engagement with the generally horizontally disposed precoated outwardly facing surface of the inner longitudinal edge portion which is destined to form the seam 22. Molten is intended to mean that the adhesive material is at a temperature above that at which essentially all crystallinity is removed. This insures that the material fills portions of the valleys of the corrugations to enhance the bonding thereof with portions of the mating corrugated surface.

The composition of the material introduced by the extruder 56 may be the same as that which had been precoated on the tape 14. Specifically, the stripe 21 may be a polyethylene acrylic acid copolymer adhesive available in pellet form from the Dow Chemical Company under the designation PZ449. The adhesive copolymer material may have a melt index in the approximate range of 6 to 8.

Melt index is defined as that amount, in grams, of a thermoplastic resin which can be forces through an orifice of 0.0825 inch diameter when subjected to a force of 2160 grams in ten minutes at 190° C. The test is performed by an extrusion rheometer described in ASTM D 1238. It is most widely used in classifying polyethylene resins, but is sometimes used for evaluating acrylics, ABS, polystyrene and nylon. Melt index values for commercial polyethylenes range from 0.1 to about 20. Those of low melt index have high molecular weights, and are used mainly for heavy duty applications such as pipe. The high melt index polymers are of low molecular weights, used for extrusion and molding of flexible products.

It will be recalled that at the seam 22, at least those longitudinal portions of the metallic strip 14 which face each other at the seam have been precoated with the adhesive copolymer material. The stripe 21 of adhesive material is extruded longitudinally generally centered along the width of the seam (see FIG. 2) so that when the seam is closed, the stripe will engage with the adhesive on the opposing faces of the precoated tape 14. In this way, when the overlapping portions are pressed together, the adhesive material of the stripe 21 tends to fill the portions between the peaks and the valleys of the corrugations.

While the adhesive copolymer is generally the same material as that which is used to precoat the aluminum tape 14, it is not without the bonds of this invention to precoat the inwardly facing surface 15 of the tape 14 with a stripe of an adhesive copolymer having a higher melt index and acrylic acid content, for example, than on the outwardly facing surface. See, for example, U.S. Pat. No. 3,703,605, incorpoated by reference hereinto.

Subsequently, the enclosed cable core 11 is advanced between a pair of opposed, cooperating rollers 61 and 62 which are positioned a short distance, e.g., 3 to 4 inches, downstream of the die 58. The rollers 61 and 62 each have a curvature essentially equal to that of the enclosed cable core 11. The roller 61 is comprised of three segments with a middle segment 64 being an aluminum disc.

The rollers 61 and 62 coact in applying forces to the enclosed core 11 in order to maintain the core in a circular configuration and to press together the overlapped portions of the moisture barrier 13 in order to obtain a reliably sealed seam 22. The downstream end (see FIG. 5) of the mandrel 53 interposed between the core 11 and the moisture barrier 13, extends between the coacting rollers 61 and 62. Hence, the mandrel 53 acts as an anvil for the forces applied by the cooperating action of the rollers 61 and 62 to the enclosed cable core, thereby preventing damage thereto.

As the rollers 61 and 62 coact and apply compression forces to the moisture barrier 13, the opposing faces of the corrugations tend to become contiguous. For those misregistered corrugations, the stripe 21 supplies the adhesive connection between the precoated adhesive material on the faces thereof which would otherwise be spaced apart along some portions of the overlap, thereby presenting undesirably a path for moisture.

A nozzle 65 (see FIG. 5) directs chilled air having a temperature of about 20° F into engagement with the disc 64 to prevent adhesive from accumulating thereon. The chilled air also begins to promote desirably a cooling of the molten adhesive material in the seam area. The subsequent advance of the covered cable core 11 through the chilling chamber 35 cools rapidly the molten adhesive copolymer material to seal the seam 22. The chilling in the chamber 35 is accomplished by a plurality of cold air vortex tubes (not shown) with the air having a temperature of about 20° F. Desirably, the chamber 35 is located as close as possible to the downstream side of the coacting rollers 61 and 62, and typically on the order of 2 inches.

The use of the above-described technique provides a surprisingly uniformly sealed seam 22. The application of the forces to the seam 22 apparently causes the molten adhesive copolymer material which comprises stripe 21 to flow into engagement with the adjacent heated surfaces forming the seam. Any voids are filled by the supplemental adhesive flowing between the corrugations during the reforming of the overlap.

Another prior art problem which is addressed by the principles of this invention relates to the amount of heat necessary to insure a seal at the overlapped seam 22. When the aluminum tape 14 is fully coated on its outer side with adhesive copolymer, that copolymer may act as an insulating barrier to the transfer of heat from the polyethylene jacket to the aluminum. In order to transfer the necessary heat through the insulating barrier in order to seal the seam when using conventionally the double-side-coated tape, certain precautions may have to be taken to avoid degrading the jacketing material.

It should be observed that although the tape 14 is precoated with an adhesive material, merely wrapping the moisture barrier 13 about the core 11 does not cause a sealing of the seam 22. The bonding temperature of the adhesive material to the metal tape 14 is such that the bonding occurs by the application of external heat or during the extrusion of the jacket 23 thereover. By practicing the methods of this invention, the hereinbefore-described problem is avoided. The sealing of the seam is achieved prior to the jacketing operation. As a result, the temperature of the jacket extrudate need only be as high as required to jacket and not that required for the dual function of sealing the seam.

EXAMPLES

In one example, a 600 pair, 20 gauge conductor cable core 11 approximately 2.55 inches in diameter was enclosed with a moisture barrier 13 which included a 4 mil thick aluminum tape having each major face thereof precoated with a 2 mil thick covering of adhesive copolymer. The core 11 was advanced at a line speed of approximately 50 feet per minute through the belt former 33 and past the device 51 to open the overlapped seam. A stripe 21 of adhesive copolymer was extrusion-introduced into the seam being subjected to air heated to a temperature of 1000° F. The pressure rollers 61 and 62 applied forces to the barrier 13 to seal the seam.

In another example, a 27 pair, 22 gauge expanded insulation covered conductor core having a diameter of approximately 0.82 inch was advanced at a line speed of 140 feed per minute. A moisture barrier of the same construction described in the foregoing example was wrapped about the core to form an overlapped seam which was sealed by the introduction of the stripe 21 of adhesive copolymer thereinto with the subsequent application of closing forces.

The apparatus 30 may also include facilities for applying additional closing forces to the seam 22 subsequent to the passage through the chilling station 35 where the enclosed core is subjected to an environment having a temperature generally below 32° F. As can be seen in FIG. 5, a second pair of coacting rollers 66 and 67 are positioned downstream of the chilling station 35.

The roller 66 is formed with a larger radius of curvature than that of the enclosed core 11 to insure engagement thereof with the seam 22. The face of the roller 67, similar to the rollers 61 and 62, has a radius of curvature essentially equivalent to that of the enclosed core 11.

While the use of the rollers 66 and 67 is optional, they offer additional assurance that the seam 22 is closed consistently along the length of the cable 10.

In the preferred embodiment described hereinbefore, the device 54 directs heated air into engagement with the seam 22. While this is preferred to cause a more uniform distribution of the extruded adhesive material, it may not be required in all cases. Its use depends, for example, on the type of adhesive material used and the quality tolerances desired for the finished product. Similarly, the use of the chilling facilities 35 may also be optional in specific applications.

It is to be understood that the above-described arrangements are simply illustrative of the principles of the invention. Other arrangements may be devised by those skilled in the art which will embody the principles of the invention and fall within the spirit and scope thereof.

What is claimed is:

1. A method of manufacturing a cable, which includes the steps of:

advancing a cable core along a path;

applying a corrugated metallic strip around the core with at least one overlapped seam, the strip having inwardly and outwardly facing major surfaces, the inwardly facing surface facing the core, each of which major surfaces is at least partially precoated with an adhesive copolymer material, the adhesive copolymer material being positioned along each of the adjacent, mating portions of the major surfaces of the metallic strip which face each other and form the overlapped seam, the adhesive copolymer material being characterized by being capable of maintaining a definite form at ambient temperature and being capable of developing an adhesive bond with the metallic strip at a predetermined temperature above ambient temperature;

spacing apart the overlapping edge portions such that the outwardly facing surface of the innermost longitudinal edge portion of the strip in the overlapped seam is oriented substantially horizontally;

applying heat transfer convectively to the overlapped seam of the strip;

flowing molten adhesive copolymer material into engagement with the precoating on the outwardly facing surface of the longitudinal edge portion of the innermost longitudinal portion of the strip which comprises the seam, the adhesive copolymer material flowed into engagement with the precoated adhesive copolymer material capable of developing an adhesive bond at a predetermined temperature above ambient with the precoated adhesive copolymer material on the adjacent inwardly facing surface of the outermost longitudinal edge portion of the strip which comprises the seam;

applying forces to the strip to reform the overlapped seam and to cause the molten adhesive material supported in engagement with the precoating on the innermost longitudinal edge portion to engage the precoating on the inwardly facing surface of the outermost longitudinal edge portion to seal the seam; and cooling the overlapped seam to cooperate with the application of forces thereto to facilitate sealing the seam; while providing support for the strip during the reforming of the seam to prevent damage to the core and to the strip.

2. The method of claim 1, which also includes the step of:

maintaining a proper positional relationship between the adjacent mating portions of the major surfaces of the metallic strip which face each other at the overlapped seam during the flowing of the molten adhesive copolymer material into engagement with the outwardly facing surface of the innermost longitudinal edge portion.

3. An apparatus for manufacturing a cable, which includes:

means for advancing a cable core along a path;

means for applying a corrugated metallic strip around the core with at least one overlapped seam, the strip having inwardly and outwardly facing major surfaces the inwardly facing surface facing the core, each of the major surfaces being partially precoated with an adhesive copolymer material, the adhesive copolymer material positioned along each of the adjacent, mating portions of the major surfaces of the metallic strip which face each other and form the overlapped seam, the adhesive copolymer material being characterized by being capable of maintaining a definite form at ambient temperature and being capable of developing an adhesive bond with the metallic strip at a predetermined temperature above ambient temperature;

means for spacing apart the overlapped edge portions such that the outwardly facing surface of the innermost longitudinal edge portion of the strip in the overlapped seam is oriented substantially horizontally;

means for applying heat transfer convectively to the overlapped seam of the strip;

means for flowing molten adhesive copolymer material into engagement with the precoating on the outwardly facing surface of the longitudinal edge portion of the innermost longitudinal portion of the strip which comprises the seam, the adhesive copolymer material flowed into engagement with the precoated adhesive copolymer material capable of developing an adhesive bond at a predetermined temperature above ambient with the precoated adhesive copolymer material on the adjacent inwardly facing surface of the outermost longitudinal edge portion of the strip which comprises the seam; and means for reforming the overlapped seam to cause the molten adhesive material and the precoating material to cooperate to form a sealed seam between overlapping portions of the corrugated metallic strip.

4. The apparatus of claim 3, wherein the spacing apart means includes means for maintaining a proper positional relationship between the adjacent mating portions of the major surfaces of the metallic strip which face each other at the overlapped seam during the flowing of the molten adhesive copolymer material into engagement with the outwardly facing surface of the innermost longitudinal edge portion;

5. The apparatus of claim 3, wherein the means for reforming the seam includes:

means for applying forces to the strip to reform the overlapped seam and to cause the molten adhesive material supported in engagement with the precoating on the innermost longitudinal edge portion to engage the precoating on the inwardly facing surface of the outermost longitudinal edge portion to seal the seam;

means for cooling the overlapped seam to cooperate with the application of forces thereto to facilitate sealing the seam; and means for providing support for the strip during the reforming of the seam to prevent damage to the core and to the strip.

6. The apparatus of claim 3, wherein the adhesive copolymer material which is flowed into engagement with the outwardly facing surface of the innermost longitudinal edge portion of the strip is the same adhesive copolymer material as that precoated on the inwardly and outwardly facing major surfaces of the strip.

7. The apparatus of claim 5, wherein the means for applying forces to the strip includes a pair of coating rollers mounted rotatably on axes extending transversely of the longitudinal axis of the cable on opposite sides of the cable such that one of the rollers engages the seam, the means for supporting the strip during reforming includes a mandrel disposed longitudinally of the cable core in engagement with the inwardly facing surface of the innermost longitudinal edge portion and extending between the coacting rollers, and the spacing apart means includes a member upstanding from and connected to the mandrel such that the longitudinal edge of the innermost longitudinal edge portion of the strip is advanced past the member while the outermost longitudinal edge portion is advanced over the member to space apart the longitudinal edge portions of the strip and thereby permit the flowing of the molten adhesive copolymer material into engagement with the outwardly facing surface of the innermost longitudinal edge portion.

8. The apparatus of claim 5, wherein the means for applying forces to the strip is effective to cause the molten adhesive copolymer material to fill voids between overlapping longitudinal edge portions of the strip which are caused by misregistration of the corrugations.

* * * * *

UNITED STATES PATENT OFFICE

CERTIFICATE OF CORRECTION

Patent No. 4,035,211 Dated July 12, 1977

Inventor(s) ROBERT GEORGE BILL and EDWARD LOUIS FRANKE, JR.

It is certified that error appears in the above-identified patent and that said Letters Patent are hereby corrected as shown below:

Column Abstract, line 5, "overlapping" should read --overlapped--; Column 2, line 9, "Zetabon" should read --Zetabon ® "--; Column 3, line 39, "overlappd" should read --overlapped--; Column 4, line 25, "includeds" should read --includes--; Column 4, line 28, "lines" should read --line--; Column 4, line 36, "overlappd" should read --overlapped--; Column 5, lines 25 and 26, delete "After the extrusion of the faces of the corrugated tape 14";

Column 7, line 60, "incorpoated" should read --incorporated--;

Signed and Sealed this

Second Day of January 1979

[SEAL]

Attest:

RUTH C. MASON
Attesting Officer

DONALD W. BANNER
Commissioner of Patents and Trademarks